US009474399B2

(12) United States Patent
Cross

(10) Patent No.: US 9,474,399 B2
(45) **Date of Patent: *Oct. 25, 2016**

(54) CONSTRUCTIBLE EATING UTENSIL WITH SCOOP FROM FOLDABLE BLANK

(71) Applicant: EcoTensil Inc., Corte Madera, CA (US)

(72) Inventor: Peggy V. K. Cross, Larkspur, CA (US)

(73) Assignee: ECOTENSIL INC., Corte Madera, CA (US)

( * ) Notice: Subject to any disclaimer, the term of this patent is extended or adjusted under 35 U.S.C. 154(b) by 176 days.

This patent is subject to a terminal disclaimer.

(21) Appl. No.: 14/242,825

(22) Filed: Apr. 1, 2014

(65) Prior Publication Data

US 2014/0259697 A1 Sep. 18, 2014

Related U.S. Application Data

(63) Continuation of application No. 13/528,161, filed on Jun. 20, 2012, now Pat. No. 8,695,828, which is a continuation of application No. 11/559,518, filed on Nov. 14, 2006, now Pat. No. 8,210,381.

(51) Int. Cl.
*B65D 41/56* (2006.01)
*A47G 21/04* (2006.01)
(Continued)

(52) U.S. Cl.
CPC ..... *A47G 21/04* (2013.01); *B65D 51/246* (2013.01); *B65D 51/247* (2013.01); *A47G 2021/002* (2013.01)

(58) Field of Classification Search
CPC .. B65D 51/246; B65D 51/247; A47G 21/04; A47G 21/045; A47G 2021/002
USPC ..... 215/228; 220/62, 212, 212.5, 729, 735; 229/125.03; 30/47, 147, 149, 324–328
See application file for complete search history.

(56) References Cited

U.S. PATENT DOCUMENTS 636,735 A 11/1899 Davenport
1,128,114 A 2/1915 Doellinger
(Continued)

FOREIGN PATENT DOCUMENTS

GB 2249470 A 5/1992
JP 52012089 U 1/1977
(Continued)

OTHER PUBLICATIONS

Eco-Scoop—Light Objects—A Design Competition About Sustainability—printed Sep. 16, 2011—url: http://www.core77.com/lightobjects/brief.asp and http://www.core77.com/lightobjects/img/1344/default.asp referencing an exhibition starting in Oct. 17, 2006.
(Continued)

*Primary Examiner* — Anthony Stashick
*Assistant Examiner* — Robert Poon
(74) *Attorney, Agent, or Firm* — Patent Law Offices Michael E. Woods; Michael E. Woods

(57) ABSTRACT

A single, thin piece of folded material attaches to a single serving container to provide a strong, sanitary spoon, Folding score lines on the handle portion of the spoon give the utensil strength and provide a simplicity of use suitable for children. The disclosed utensil may be attached to existing containers or may be built into containers during the manufacture of the underlying container, or may be available as a stand-alone product. The disclosed utensil may be integrated into packaging material as overwrap sleeves used to package food containers.

10 Claims, 4 Drawing Sheets

(51) Int. Cl.
*B65D 51/24* (2006.01)
*A47G 21/00* (2006.01)

(56) References Cited

U.S. PATENT DOCUMENTS

| | | | | |
|---|---|---|---|---|
| 1,521,768 | A | 1/1925 | Herrmann | |
| 1,625,335 | A | 4/1927 | Schneider | |
| 1,633,605 | A * | 6/1927 | Prudden | B65D 51/246 229/125.03 |
| 1,657,325 | A | 1/1928 | Suttle | |
| 1,808,949 | A | 6/1931 | Flynn | |
| 1,851,942 | A | 3/1932 | Christie | |
| 1,907,737 | A | 5/1933 | Christie | |
| 2,375,266 | A | 5/1945 | Wilson | |
| 2,433,926 | A | 1/1948 | Sayre | |
| 2,453,393 | A | 11/1948 | Wilson | |
| 2,598,987 | A * | 6/1952 | Franzen | B65D 51/246 215/228 |
| 2,728,516 | A | 12/1955 | Rodman | |
| 2,745,586 | A | 5/1956 | Thoma | |
| 3,334,778 | A | 8/1967 | Saunders | |
| 3,367,484 | A | 2/1968 | Nelson | |
| 3,380,307 | A | 4/1968 | Frank | |
| 3,458,107 | A | 7/1969 | Lane et al. | |
| 3,487,974 | A * | 1/1970 | Schovee | B65D 51/246 220/212 |
| 3,514,029 | A | 5/1970 | Powell | |
| 3,623,632 | A * | 11/1971 | Chang | A47G 19/2205 215/229 |
| 3,722,779 | A | 3/1973 | Chang | |
| 3,828,999 | A | 8/1974 | Humphrey | |
| 3,931,925 | A * | 1/1976 | Ruff | A47G 21/04 229/125.03 |
| 3,955,742 | A | 5/1976 | Marshall et al. | |
| 3,961,566 | A | 6/1976 | Westphal et al. | |
| 4,036,398 | A | 7/1977 | Hoogvelt et al. | |
| 4,060,176 | A | 11/1977 | Tobiasson | |
| 4,201,795 | A | 5/1980 | Yamanaka | |
| 4,218,010 | A | 8/1980 | Ruff | |
| D257,406 | S | 10/1980 | Ouellette | |
| 4,251,097 | A | 2/1981 | Whitten, II | |
| 4,324,343 | A | 4/1982 | Moller | |
| 4,348,421 | A | 9/1982 | Sakakibara et al. | |
| 4,393,988 | A * | 7/1983 | Burke | A47G 21/04 229/125.03 |
| D270,887 | S | 10/1983 | Allgeyer et al. | |
| 4,413,034 | A | 11/1983 | Anderson | |
| 4,635,843 | A | 1/1987 | Tomlinson | |
| D295,383 | S | 4/1988 | Anderson et al. | |
| 4,836,593 | A | 6/1989 | Cooley | |
| D309,210 | S | 7/1990 | Seyfert | |
| 4,940,189 | A | 7/1990 | Cremonese | |
| 4,962,849 | A | 10/1990 | Anderson | |
| 5,011,006 | A | 4/1991 | Anderson | |
| 5,381,905 | A | 1/1995 | Mallmamm et al. | |
| 5,419,049 | A | 5/1995 | MacArthur-Onslow | |
| 5,695,084 | A | 12/1997 | Chmela et al. | |
| 5,705,212 | A | 1/1998 | Atkinson | |
| 5,797,636 | A | 8/1998 | Hamynen | |
| 5,878,461 | A | 3/1999 | Killian | |
| 5,884,953 | A | 3/1999 | Leighton et al. | |
| 5,992,667 | A | 11/1999 | Huang | |
| 6,247,735 | B1 | 6/2001 | Berkman | |
| 6,308,833 | B1 | 10/2001 | Oravez | |
| 6,371,324 | B1 | 4/2002 | Torniainen et al. | |
| 6,604,645 | B1 | 8/2003 | Vaupotic | |
| 6,604,646 | B2 | 8/2003 | Torniainen et al. | |
| D530,986 | S | 10/2006 | Lago-Arenas | |
| 7,275,652 | B2 | 10/2007 | Morris et al. | |
| D554,951 | S | 11/2007 | McGrath | |
| D571,162 | S | 6/2008 | Fite, IV et al. | |
| 7,597,063 | B2 | 10/2009 | Hartzell | |
| 7,637,417 | B2 | 12/2009 | Fite, IV et al. | |
| D612,692 | S | 3/2010 | Menceles | |
| 7,823,743 | B2 | 11/2010 | McKahan et al. | |
| D646,529 | S | 10/2011 | Cross | |
| D651,480 | S | 1/2012 | Cross | |
| 8,201,862 | B2 | 6/2012 | Langley | |
| 8,210,381 | B2 | 7/2012 | Cross | |
| 8,695,828 | B2 * | 4/2014 | Cross | B65D 51/246 215/228 |
| 2002/0060220 | A1 | 5/2002 | Torniainen et al. | |
| 2002/0114870 | A1 | 8/2002 | Rebhorn et al. | |
| 2005/0115974 | A1 | 6/2005 | Micciulla | |
| 2007/0084064 | A1 | 4/2007 | Fite et al. | |
| 2007/0227919 | A1 | 10/2007 | True | |
| 2008/0072432 | A1 | 3/2008 | Teys et al. | |
| 2008/0110885 | A1 | 5/2008 | Cross | |
| 2008/0245682 | A1 | 10/2008 | Foulke | |
| 2010/0194128 | A1 | 8/2010 | Langley | |
| 2011/0303678 | A1 | 12/2011 | Zomorodi et al. | |
| 2012/0052162 | A1 | 3/2012 | Goulart | |
| 2013/0097877 | A1 | 4/2013 | Cross | |
| 2014/0069933 | A1 | 3/2014 | Cross | |
| 2014/0103675 | A1 | 4/2014 | Cross | |

FOREIGN PATENT DOCUMENTS

| | | | |
|---|---|---|---|
| JP | 53068780 | U | 6/1978 |
| JP | 3032192 | U9 | 10/1996 |
| JP | 10019636 | A | 1/1998 |
| JP | 2000162016 | A | 6/2000 |
| JP | 2000166735 | A | 6/2000 |
| JP | 3281262 | B2 | 5/2002 |
| JP | 3374276 | B2 | 2/2003 |
| JP | 3636280 | B2 | 4/2005 |
| KR | 1020020026221 | A | 4/2002 |
| KR | 200382814 | Y1 | 4/2005 |
| WO | 2007048055 | A2 | 4/2007 |
| WO | 2008061080 | A2 | 5/2008 |
| WO | 2014042705 | A1 | 3/2014 |
| WO | 2014059369 | A1 | 4/2014 |

OTHER PUBLICATIONS

11559518—EcoScoop_Arran Smith.pdf, "Eco-Scoop Biodegradable Eating Utensil", Arran Smith, Corflot, 2004 Exhibition, pp. 1-5, http://www.coroflot.com/ags/Eco-Scoop/1, Retrieved Dec. 5, 2011.

* cited by examiner

CONSTRUCTIBLE EATING UTENSIL WITH SCOOP FROM FOLDABLE BLANK

CROSS REFERENCE TO RELATED APPLICATIONS

This application is a continuation of U.S. patent application Ser. No. 13/528,161, filed 20 Jun. 2012, which is a continuation of U.S. patent application Ser. No. 11/559,518, filed 14 Nov. 2006 (Now U.S. Pat. No. 8,210,381), the entireties of the contents thereof expressly incorporated by reference thereto for all purposes.

STATEMENT REGARDING FEDERALLY SPONSORED RESEARCH OR DEVELOPMENT

Not Applicable

REFERENCE TO A SEQUENCE LISTING

Not Applicable

BACKGROUND OF THE INVENTION (1) Field of the Invention

The invention relates to means and methods of creating folding eating utensils suitable for attachment to food covers, lids or containers.

(2) Description of the Related Art

Several attempts to integrated eating utensils with food containers are known in the related art. However, the related art fails to provide the advantages of the present invention.

U.S. Pat. No. 4,39,988 to Burk discloses a deformable container-lid that includes a spoon. Unfortunately, the Burke lid cannot be molded in one piece, as the utensil member is attached perpendicularly to the lid, which renders it cost prohibitive for single serve containers.

U.S. Pat. No. 6,604,645 to Vaupotic discloses a separate removable spoon that is stored diagonally in a square storage lid. The Vaupotic spoon assembly is dependent upon the use of a square food container.

U.S. Pat. No. 6,371,324 to Torniainen discloses two spoon parts stored within a food lid. The Torniainen spoon requires assembly and is thus not well suited for children who are still developing their fine motor skills. The Tornianinen configuration requires three layers of material, a bottom cap to cover the food, a middle section compromising a two-part spoon, and a top section to cover the two spoon.

BRIEF SUMMARY OF THE INVENTION

The present invention overcomes shortfalls in the related art by combining a lid and eating utensil in a manner that is easy to use, requires minimal materials to manufacture and may be made from recycled and/or degradable material, such as a waxed or laminated paperboard (cardboard).

The manufacturing and application of the present invention is based upon existing technology and the same technology that manufactures are already using to apply lids, so that the set-up is easily configured and application processes would be very cost efficient. The addition of the lid spoon on top of the existing hermetically sealed sheet serves as an additional tamper proofing device and additional protection of the inner sheet or film from breakage, and improves stackability.

The present invention has a minimal impact on the environment due to the minimal amount of material used, the biodegradable option for material, both of which have less impact on the environment than use of a separate plastic spoon used in the related art. The use of a separate spoon is typical in a "take-away" situation where a single serving container is purchased and taken away for consumption at another location.

Consumers, even children will find the two-step deformation and use of the utensil very easy and appealing. The disclosed utensil holds an appropriate amount of foodstuff with a semi solid viscosity, such as yogurt, and has a pleasing mouth feel.

The invention is of service to busy parents and all others who utilize convenient take-away foods in cups or other containers which require a utensil for consumption, as the user will no longer have to seek-out and pack a separate utensil every time they pack the take-away item.

The invention also makes life easier for consumers to utilize the utensil when at home, as the invention saves the steps of seeking out a utensil and washing the utensil after use.

Unlike the related art, the present invention provides a score line along the intersection of the "scoop" and the lid edge such that the "scoop" is folded under the lid where it is kept sterile. The scoop is unfolded along the score area and deployed outwardly of the lid. The lid is then folded or bent perpendicularly to the score line, possible along a second score line running all or part of the diameter of what becomes the utensil "handle".

The bending of the lid causes a corresponding bending or curvature in the scoop portion creating a ridged, arched scoop for dispensing or scooping food held in the container. The adhesive which attaches the lid to the container may serve to hold the folded edges to each other, thereby keeping the scoop in the deployed position even when the invention is not being held by the user. The hermetically sealed lid that already exists on most single serve food products would remain in place, such that the "scoop" would be both sterile and uncontaminated by any foodstuff.

The scoop creates both a ridged structure for scooping heavy foodstuffs and also a pleasing mouth feel. Because the lid is curved in the center, it is narrow enough to reach into relatively deep containers, such as standard yogurt containers.

Since the structure of the deployed utensil is created by the inherent strength of the tension and compression of the inverted arch of the bent lid, very little material is required for strength.

The invention is a simple and highly cost effective product to create and utilize due to the extreme simplicity of manufacturing and the ability to place the invention on top of existing packaging. The invention may be viewed as a secondary lid to be placed or attached upon food containers. The invention may be placed in or upon food containers by manufactures, or may be purchased by consumers as a stand-alone product that is later attached to containers as needed. The invention may also be integrated into sleeves that cover or contain multiple containers.

The outer lid surface may include an easy to understand graphic to demonstrate the two easy steps required to implement the utensil: "1) unfold scoop. 2) Bend lid the other direction so that the two big red dots meet", or some such direction so that even a small child may look at the picture and "get it".

OBJECTS AND ADVANTAGES OF THE INVENTION

Accordingly, several objects and advantages of this invention are to provide an eating utensil or scooping device which is capable of being attached to a container or integrated into packaging and used to scoop material within a food container, without the necessity of acquiring a separate utensil.

It is yet a further object and advantage of the invention to provide a scooping device which is relatively inexpensive to manufacture and attach to containers, due to the minimal amount of material used and simplicity of structure, as compared to the related art. The invention uses existing technologies to create a product that has a minimal impact on the environment.

It is still a further object and advantage of the invention to provide a device in which the utensil portion of the device is sterile and, when needed, uncontaminated by the contents within the container.

When the invention is deformed there is no likelihood that the contents of the container will be touched by the hands of the user when a sealing membrane is used. The utensil will be preferably remain in the deformed position by adhesive, without being held or pinched in place by the user.

It is still a further object and advantage of the invention to provide a device in which the utensil is a structurally strong scoop due to the tension and compression force created by the inverted arching shape.

It is still a further object and advantage of this invention to provide a device in which the deformation is easy to manipulate and readily understandable even by children, and the scoop formed by the deformation of the invention is suitably constructed to provide a reliable and pleasing utensil capable of withstanding usage as an eating utensil during the consumption of the entire contents of the container.

These and other objects and advantages will be made apparent when considering the following detailed specification when taken in conjunction with the drawings.

DRAWINGS

Reference Numerals

1—lid utensil or the present invention
2—utensil I scoop
3—lid/handle/base
4—score
5*a* and 5*b*—edges of lid that come together to create scoop
6—perpendicular score
7—adhesive
8—a sealing membrane (used as needed)
9—a portable container
10*a* and 10*b*—optional score lines starting from the base and ending at the scoop
11—an external cap or external lid
12—extension section
13—an overwrap sleeve
14—a side section of the overwrap sleeve containing a scooping 2 section.
15—an alternative configuration wherein scooping section 2 is folded under the overwrap sleeve 13
16—tab for identification of invention as the invention is integrated into various packaging configurations

DETAILED DESCRIPTION OF THE INVENTION

Figure 1:
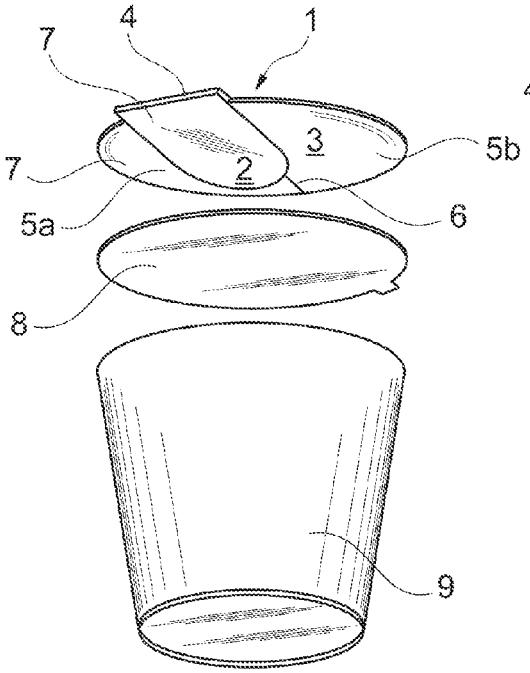
FIG. 1 is a bottom, perspective view of the present invention shown with a typical yogurt style container and sealing membrane.
Figure 2:
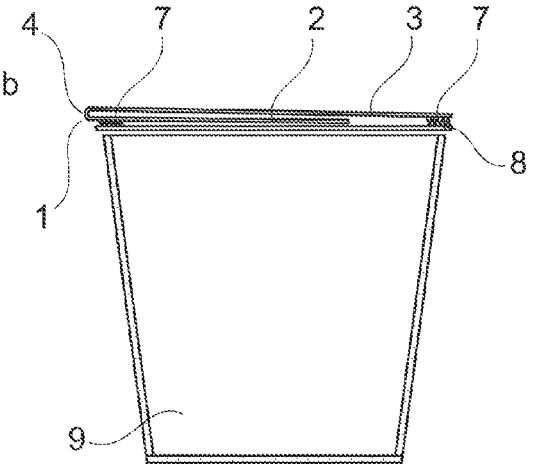
FIG. 2 is a sectional side view of the invention showing its placement on top of a container with a sealing membrane.

The preferred embodiment of the present invention is illustrated in FIG. 1 in a perspective view, and in FIG. 2 in an elevation view, of a basic version of the present invention 1 in conjunction with a portable container 9 and its sealing membrane 8. The invention may be placed anywhere upon a product or supplied separately, unattached to a product.

Figure 4:
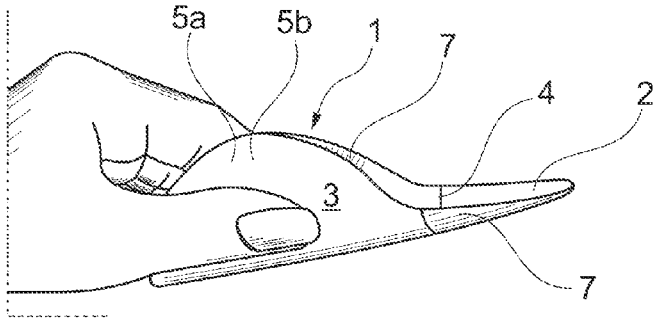
FIG. 4 is a perspective view showing the utensil in final deployed condition, suitable for use as a scooping device.

The handle 3 section of the invention is shown as having a planar top and bottom surfaces, preferably with a re-stickable adhesive along the bottom rim, especially at points 5*a* and 5*b*. The adhesive 7 attaches the lid to the membrane 8 and also attaches points 5*a* and 5*b* when devise is in final deployed position (FIG. 4). The membrane 8 is attached to the container 9. Adhesive 7 may be clear, opaque or any color.

The utensil/scoop portion of the invention 2 shown in FIG. 1 and FIG. 2, in conjunction with a portable container 9, is folded under along score 4, such that it is protected from contaminants from above by lid area 3, and protected below, if needed, by membrane 8.

Figure 3:
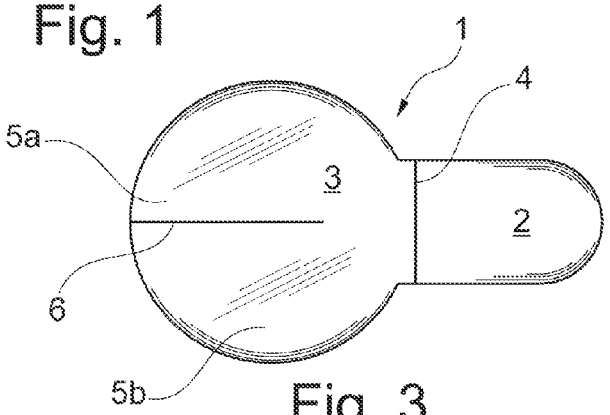
FIG. 3 is a plan view of the underside of the invention showing the utensil in an unfolded condition and the lid and utensil prior to deforming (as in FIG. 4) to final form for utilization as a scoop.

To use the present invention, the user peals the lid/handle 3 from the top of the membrane 8 and container 9 and then peals membrane 8 from container 9. The user then unfolds utensil/scoop portion 2 along score 4 to a flattened position, shown in FIG. 3.

Figure 12:
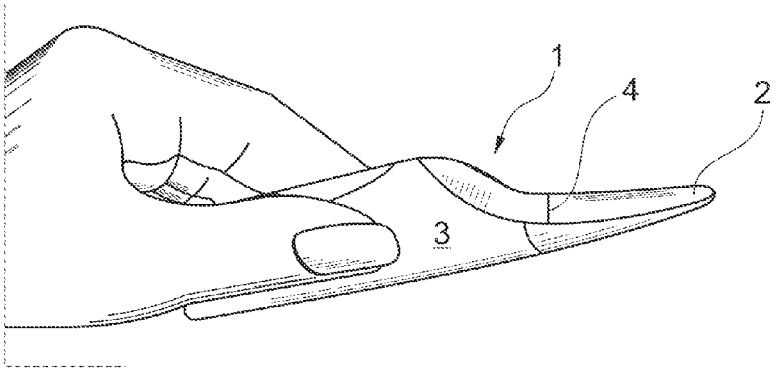
FIG. 12 is a side perspective view of the invention in a rolled position.

The user then folds or rolls lid/handle 3 along score 6, such that points 5*a* and 5*b* meet and the adhesive 7 keeps the lid/handle in the rolled or folded form, as shown in FIG. 4 or FIG. 12. The arch of the rolled lid/handle creates a structurally strong scoop at utensil/scoop portion 2 due to the compression force created on the inside of the arching shape. The arch on the inside compression side, is very strong in compression and can therefore support a load, even the weaker areas such as score area 4 is negated by the strength of the inverted arch. Score 6, which doesn't cross score 4, is helpful for communicating more intuitively how to use the utensil.

The utensil/scoop 2 created by rolling the invention also serves to help contain the foodstuff or other material and has the pleasing mouth feel of a spoon.

The large surface area 3 may be used to illustrate the two simple steps involved in forming the utensil. A big colorful arrow may be printed on utensil/scoop 2 to show in a very intuitive way to unfold the utensil/scoop 2. Two big colored dots, letters or the like could be used on the inside of areas 5*a* and 5*b* to show in a very intuitive way how these points come together.

Other Embodiments

In an alternative embodiment, the invention is not fastened to any container. The invention may snap-on to the top of a container by use of an existing rim on the container or rest loose between a snap-on lid and sealing membrane. The invention may also use restickable glue dots or other means of attachment to be secured to food containers.

Figure 5:
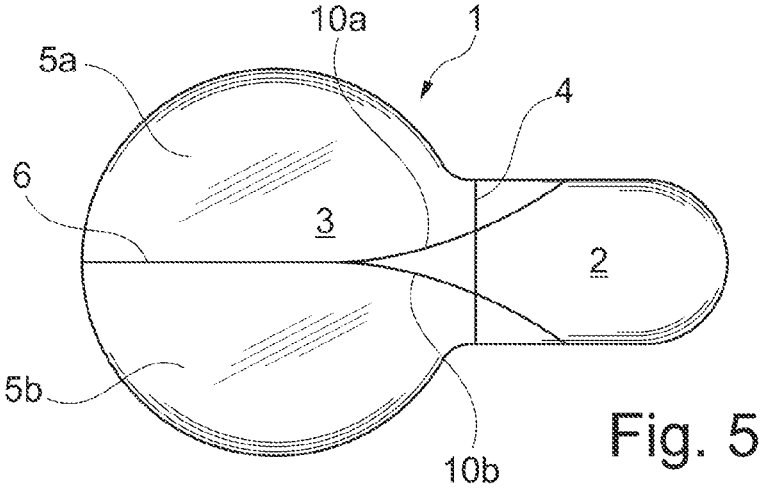
FIG. 5 is a plan view of the invention with optional score lines on the scooping section.

FIG. 5 shows a variation with curved scores 10*a* and 10*b* that intersect score 6, cross score 4 and end at the edges of the scoop portion 2.

Figure 6:
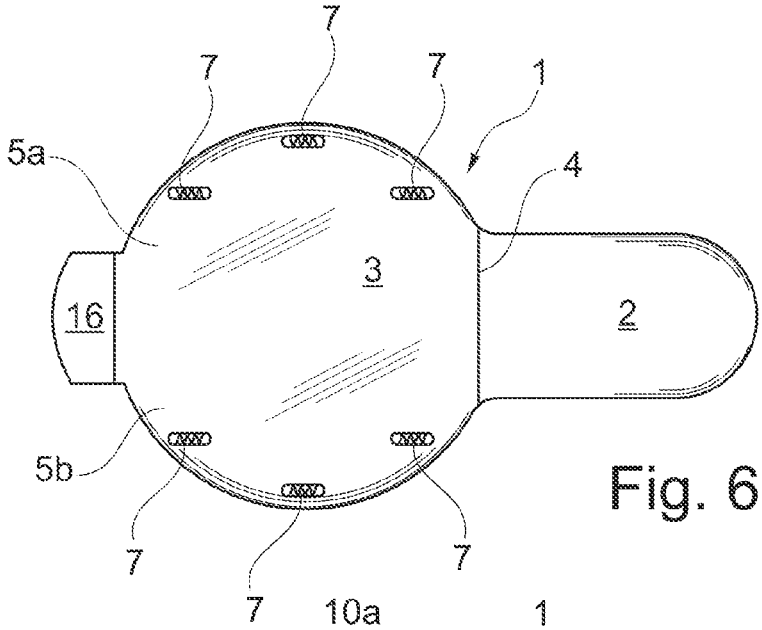
FIG. 6 is a plan view of the invention with means for attachment 7 which may be reusable glue lines or glue drops.

FIG. 6 shows a variation with an identification tab 16 at the backside of the handle portion 3. Tab 16 may be used for identification of the invention when the invention is integrated into other packaging, such as box sleeves. FIG. 6 also shows one option for placement of glue stick points 7 which may be used to secure the invention to another object and/or used to fold or roll the handle portion 3.

Figure 7:
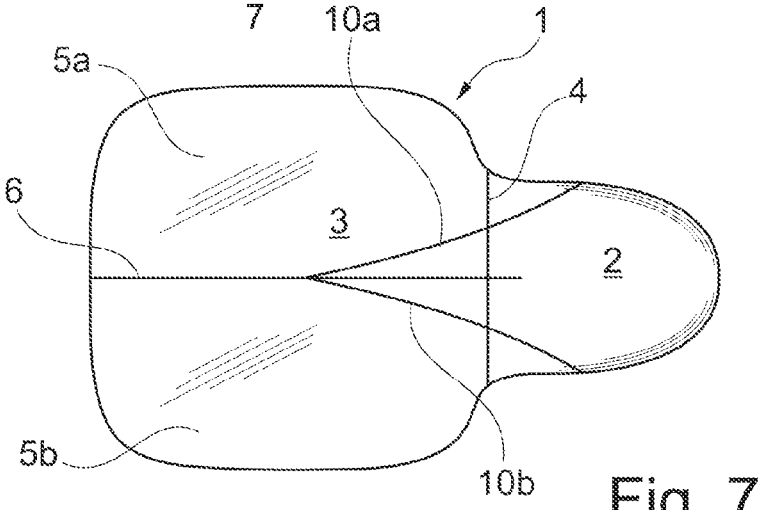
FIG. 7 is a plan view of the invention in a square shape.

FIG. 7 shows a square shaped variation with score 6 crossing over score 4. Scores 10*a* and 10*b* help shape the scooping member 2 when the handle 3 is folded or rolled. The present invention is not limited to any particular shape.

Figure 8:
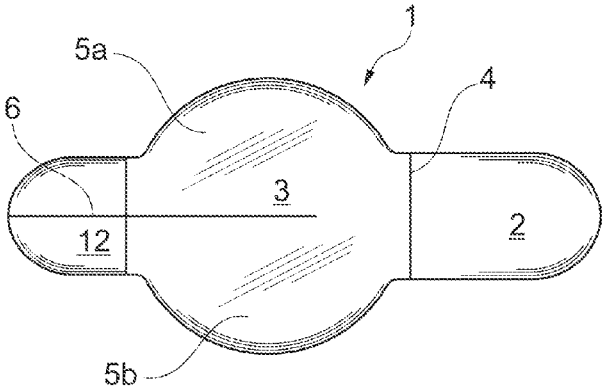
FIG. 8 is a plan view showing an extension section 12 for use with small lids with deep cups.

FIG. 8 shows a variation with an extra handle section 12 which may be used to add length to the deployed handle section 3. The extra handle section 12 may be folded under section 3. Score 6 may run thought section 12 and section 3. FIG. 8 is plan view of the invention with an extra extension section 12 for use with containers with small openings and greater depth. Sections 12 and 2 may fold under section 3 to allow the entire invention 1 to achieve a compact form. Section 12 acts as an extension to the handle 3.

Figure 9:
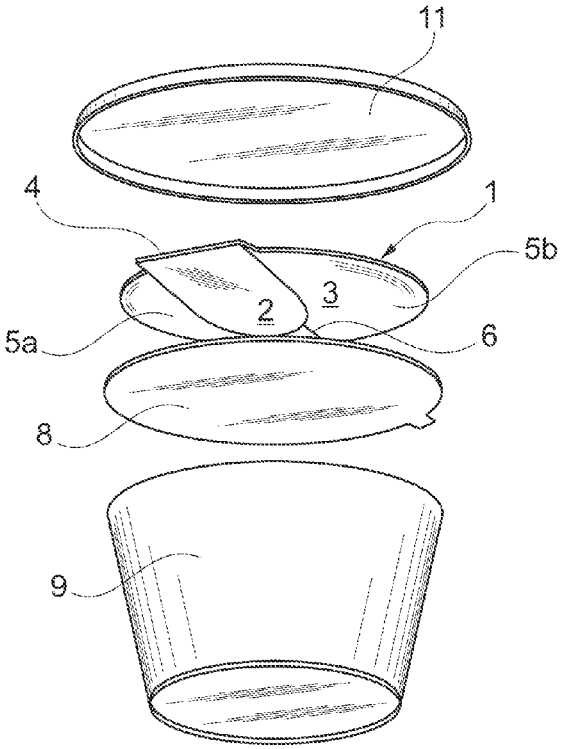
FIG. 9 is a is a perspective view showing an optional external cap or lid 11 ready for placement to secure the invention 1 to the container 9.

FIG. 9 shows an alternative embodiment where a top cap or top lid 11 is used to hold the invention 1 to the container 9. An optional membrane 8 may sit between the container 9 and the invention 1.

Figure 10:
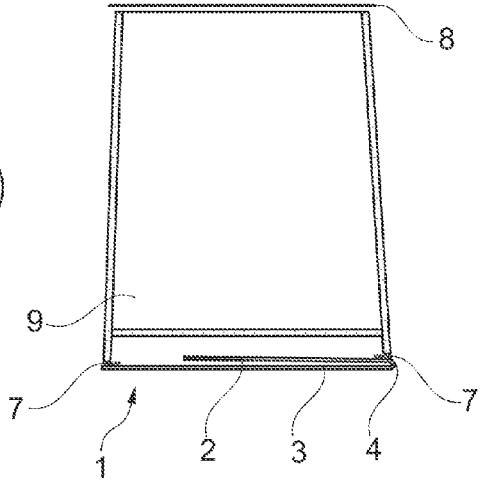
FIG. 10 is an elevation view of the invention secured to the bottom of a container.

FIG. 10 is an elevation view of a container 9 with the invention 1 folded and placed at the bottom of the container. This embodiment is well suited for containers that have a bottom base bigger than the top opening. This placement of the invention allows for configuration of the spoon portion to be long enough to reach the bottom of the container. Points of adhesion 7 attach the invention to the bottom of the container.

Figure 11:
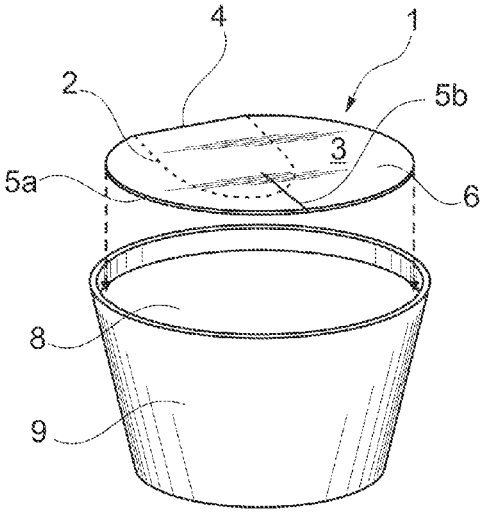
FIG. 11 is a perspective view of the invention that will sit below the lip of the container.

FIG. 11 is a front perspective view of the invention 1 being placed on top of a container 9 such that the invention rests just inside of the lip of the container.

FIG. 12 is a side perspective view of the invention in a rolled position. In this embodiment, reusable glue drops or glue points may secure the handle 3 portion of the invention.

Figure 13:
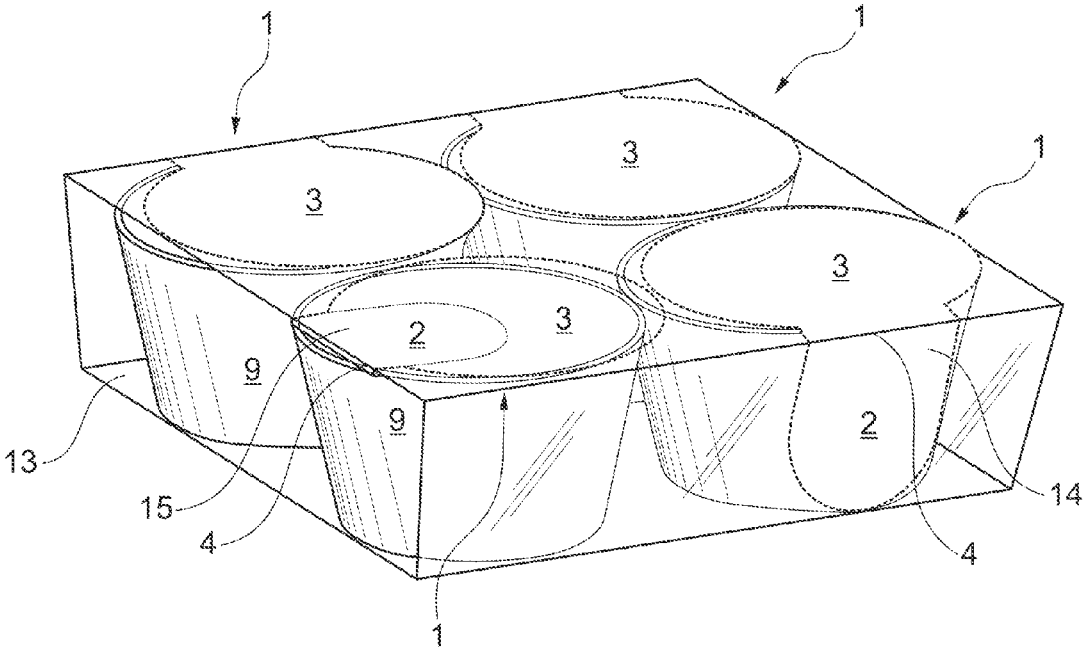
FIG. 13 is a perspective view of the invention integrated into an overwrap sleeve.

FIG. 13 is a perspective view of the invention 1 integrated into an overwrap sleeve 13. A side 14 section of the overwrap sleeve 13 containing a scooping 2 section allows for an efficiency of material use as the entire invention is integrated into the sleeve. For the open ends of the sleeve, 15 shows a configuration where scooping section 2 is folded under the handle section 3. The present invention may be integrated into other packaging.

Moreover, having thus described the invention, it should be apparent that numerous structural modifications are contemplated as being part of this invention as set forth hereinabove and as defined herein by the claims.

What is claimed as new and desired to be protected by Letters Patent of the United States is:

1. A constructible eating utensil, comprising:
a deformable generally planar paperboard sheet comprising:
a handle blank having:
an upper portion,
a lower portion,
an arcuate free end, and
an integrally connected end;
a scoop blank having:
a linear top edge,
a linear bottom edge,
a curved free end, and
an integrally connected end;
an integral transition coupling said integrally connected end of said handle blank to said integrally connected end of said scoop blank;
a scoring arrangement comprising:
a first substantially linear score extending from a first location on said handle blank to a second location along a first axis, said first substantially linear score dividing said handle blank into a pair of approximately symmetric handle portions;
a second substantially linear score proximate said integral transition and extending approximately perpendicularly to said first axis;
an upper score crossing a first portion of said second substantially linear score; and
a lower score crossing a second portion of said second substantially linear score, said first portion, said portions of said second substantially linear score on opposing sides of said first axis;
wherein said upper score and said lower score share a common terminus along said first substantially linear score;
wherein said deformable sheet is configured with said scoring arrangement so that folding said deformable sheet about said first substantially linear score constructs a utensil having a handle from said handle blank and a scoop from said scoop blank.

2. A constructible utensil, comprising:
a deformable generally planar rigid paperboard sheet defining a body, said body including:
a handle element having:
a first linear free edge,
a second linear free edge,
a third linear free edge, and
a first fixed end opposite said third linear free edge;
a central fold axis, and
a bowl element having:
a second fixed end coupled to said handle element at said first fixed end, and
a curvilinear free edge;
wherein said handle element is generally elongate and rectilinear and includes a length along said first linear free edge and said second linear free edge that is generally parallel to said fold axis and is at least two times greater than a width generally perpendicular to said fold axis;

a first bowl score disposed on said body and extending from a first point on said bowl element proximate a first end of said curvilinear free edge towards a second point on said fold axis of said handle element; and a second bowl score disposed on said body and extending from a third point on said bowl element proximate a second end of said curvilinear free edge towards said second point;

wherein said scores generally extend away from said fold axis; and wherein said body is configured with an arrangement of said scores such that a folding of said body about said fold axis introduces a bowl in said bowl element by distortion of said bowl element along said first and second scores.

3. The constructible utensil of claim 2 wherein said first and second edges include, respectively, a first and a second lateral edge and wherein said first and third points are disposed on said bowl element spaced away from said lateral edges.

4. The constructible utensil of claim 2 wherein said scores converge to said fold axis and extend along said handle element to a fourth point proximate a handle edge of said handle element opposite of said bowl element.

5. The constructible utensil of claim 4 wherein said body includes one or more indicia disposed proximate said fifth point configured to indicate appendage location for folding said body about said fold axis.

6. The constructible utensil of claim 2 wherein said folding of said body about said fold axis includes bringing a pair of lateral edges of said body on opposing sides of said fold axis together above said fold axis.

7. The constructible utensil of claim 6 wherein a folding force applied to said body folds said body about said fold axis to bring said pair of lateral edges together and wherein said body and said scores are configured to retain said pair of lateral edges above said fold axis when said folding force is removed.

8. The constructible utensil of claim 2 wherein said bowl scores each include a curved portion.

9. A constructible utensil, comprising:

a deformable generally planar rigid paperboard sheet defining a body, said body including:

a handle element having:

a first linear free edge, a second linear free edge, a proximal free edge, and a first distal end opposite said proximal free edge;

a central fold axis, and a bowl element having:

a second fixed end coupled to said handle element at said first distal end, and a curvilinear free edge;

wherein said handle element is generally elongate and rectilinear and includes a length along said first linear free edge and said second linear free edge that is generally parallel to said fold axis and is at least two times greater than a width generally perpendicular to said fold axis;

a first bowl score disposed on said body and extending from a first point on said bowl element proximate a first end of said curvilinear free edge towards a second point on said fold axis of said handle element; and a second bowl score disposed on said body and extending from a third point on said bowl element proximate a second end of said curvilinear free edge towards said second point;

wherein said scores generally extend away from said fold axis; and wherein said body is configured with an arrangement of said scores such that a folding of said body about said fold axis introduces a bowl in said bowl element by distortion of said bowl element along said first and second bowl scores.

10. The constructible utensil of claim 9 wherein each said bowl score includes a curved portion.

* * * * *